United States Patent [19]

Connell et al.

[11] 4,415,106

[45] Nov. 15, 1983

[54] MAP HOLDER

[76] Inventors: Michael J. Connell, 2766 S. 13th St.; Ronald L. Swanson, 200 Richelieu Ave., both of Omaha, Nebr. 68108

[21] Appl. No.: 275,552

[22] Filed: Jun. 19, 1981

[51] Int. Cl.[3] ..... A44C 5/00

[52] U.S. Cl. ..... 224/221; 24/3 A; 40/21 C; 40/904; 224/267; 224/236

[58] Field of Search ..... 224/219, 222, 267, 236, 224/221; 40/304, 904, 21 C, 21 R, 10 R; 280/809; 206/484, 460, 811; 24/3 A, 3 F; 63/3

[56] References Cited

U.S. PATENT DOCUMENTS

| | | | |
|---|---|---|---|
| 956,534 | 5/1910 | Lahey . | |
| 1,382,446 | 6/1921 | Warren | 224/222 |
| 1,434,775 | 11/1922 | Fenno | 224/222 |
| 1,453,671 | 5/1923 | Harrold | 224/267 |
| 1,519,142 | 12/1924 | Lakin | 24/3 F |
| 2,099,295 | 11/1937 | Canfield | 281/1 |
| 2,641,074 | 6/1953 | Richmond | 63/3 X |
| 2,876,022 | 3/1959 | Kroviak | 281/44 |
| 3,065,668 | 11/1962 | Leybourn et al. | 40/10 A |
| 3,214,852 | 11/1965 | Ford et al. | 40/21 C |
| 3,215,453 | 11/1965 | Malcom, Jr. | 281/44 |
| 3,330,057 | 7/1967 | Rodgers | 63/3 X |
| 3,407,757 | 10/1968 | Warner | 108/43 |
| 3,586,220 | 6/1971 | Reinsberg | 40/21 C |
| 3,714,308 | 1/1973 | Nettesheim | 264/46.7 |
| 3,829,995 | 8/1974 | Fakoury | 40/10 R |
| 3,921,319 | 11/1975 | Styers et al. | 40/10 R |
| 3,942,693 | 3/1976 | Tocci | 224/219 |
| 3,999,317 | 12/1976 | Owens | 40/10 R |
| 4,131,195 | 12/1978 | Worrell, Sr. | 206/484 |
| 4,301,919 | 11/1981 | Morgan | 206/460 |

OTHER PUBLICATIONS

IBM Technical Disclosure Bulletin; Wrist Worn Terminal; Ludeman et al.; Apr. 1973.

*Primary Examiner*—Allan N. Shoap
*Assistant Examiner*—Robert Petrik
*Attorney, Agent, or Firm*—Henderson & Sturm

[57] ABSTRACT

This invention relates to body supported printed surfaces in general, and more specifically to a thin, flexible ski area map holder which is easily attached to a skier's limb and provides a safe, convenient view of an appropriate map.

3 Claims, 6 Drawing Figures

MAP HOLDER

BACKGROUND OF THE INVENTION

Body supported printed surfaces are well known in the prior art, as can be seen by reference to U.S. Pat. Nos. 956,534; 2,099,295; 2,876,022; 3,215,453; and 3,407,757. All the references cited are characterized by the fact that they are intended to support a surface rigid enough to be suitable for writing thereupon, and are not designed for use where a surface of sufficient rigidity for such purpose would both obtrusively hamper the activity of the user and be a significant hazard to his safety.

With the growth of downhill skiing and cross country skiing as a recreational activity in recent years, ski areas have been increasingly enlarged, particularly in the western mountain region. This enlargement has often times resulted in a single ski are having as many as ten and more individual chair lifts, extending across two or more mountain peaks within a mountain range. It is not unusual for ski areas to have expanded to such an extent that what was originally two and perhaps three ski areas have since become a single vast network covering many miles in horizontal extent, as well as vertical fall. The use of a paper ski area map by carrying it on one's person, usually made available at no cost to the skier by the ski area, began as a convenience to the novice skier and has, as a consequence of the foregoing described growth, become a necessity to both the novice and the expert.

It should also be pointed out that there is a significant danger in a novice skiing without such a map. After taking a wrong or careless turn, a novice is likely to be forced to return by way of an expert trail which will be steeper and more hazardous then he can safely negotiate. Although trails are generally marked as to their difficulty, it is a near physical impossibility, particularly for a novice to climb back along a trail with skis mounted or carrying skis and ski poles to the point at which the wrong turn was taken.

Skiing apparel are generally amply supplied with zippered or otherwise sealable pockets without which ski area maps would be quickly lost or destroyed by moisture and wind. It being a necessity, for the most part, to ski with heavily insulated gloves or mittens in which must be carried a pair of ski poles, stopping to refer to a map to make certain of one's location or the location of a desired trail, becomes a very time consuming and cumbersome maneuver. For the novice it represents an activity which can easily result in losing either a mitten or a ski pole or unnecessarily falling upon one's side in deep snow from which position he typically will have considerable difficulty in extricating himself.

The instant invention was developed specifically as a solution to the hereinabove described problem whereby a skier, either a novice or expert can have instantly available a ski area map for convenient reference without requiring that ski poles be unstrapped from ski mittens, ski mittens be removed from hands, a ski pocket be unzippered, cold hands be required to hold a map for reference, and the reverse sequence of activities be repeated before skiing can be recommenced. It is often desirable to refer to a ski map several times during any one descent of a hill. The ski map holder would both save time and serve to make referral to a map convenient, thus avoiding the frequency of skiing without proper bearings and/or on inappropriate trails.

SUMMARY OF THE INVENTION

An object of the present invention is the provision of a ski area map holder which is very simple in its fabrication, yet provides considerable convenience when it is employed by the user.

A further object of the instant invention is the provision of a pliable, body supported map holder which will relieve a skier from the inconvenience of having to retrieve an unprotected map from a zippered pocket.

Still another object of the instant invention is the provision of a map holder whose position on a skier's exterior clothing is maintained by friction to keep it in full view at all times.

Yet another object of the instant invention is the provision of a map holder for skiers which can be manufactured at a very low cost and in great quantities, and which further should receive wide acceptance in the skiing industry, due to the benefits and added convenience which will accrue to the user.

Another object of the instant invention is the provision of a ski area map holder which is water resistant.

Still a further object of the instant invention is the provision of a ski area map holder which is adjustable to different sized users or different clothing of the same user.

Yet a further object of the instant invention is the provision of a ski area map holder which will in the long run reduce the cost of providing maps in ski areas because it will protect individual maps from wear and tear.

These and other objects and advantages and novel features of the invention will become apparent from the following detailed description of the invention when considered in conjunction with the accompanying drawings.

DESCRIPTION OF THE PREFERRED EMBODIMENT

Figure 1:
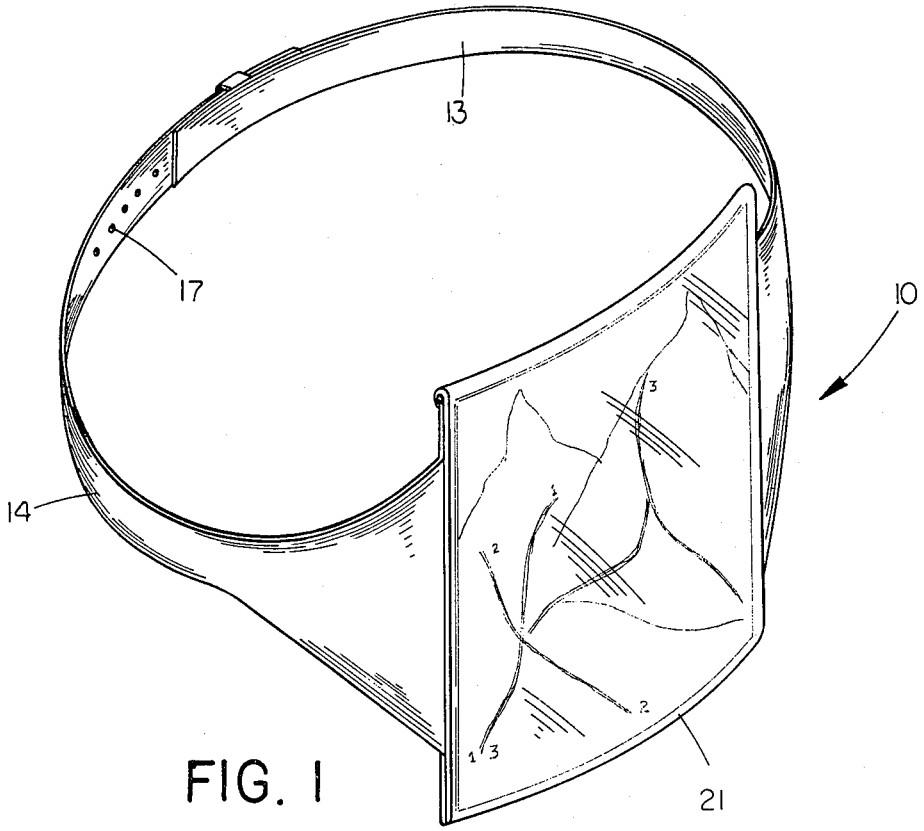
FIG. 1 is a front perspective view of the instant invention depicting the strap in a closed position.
Figure 2:
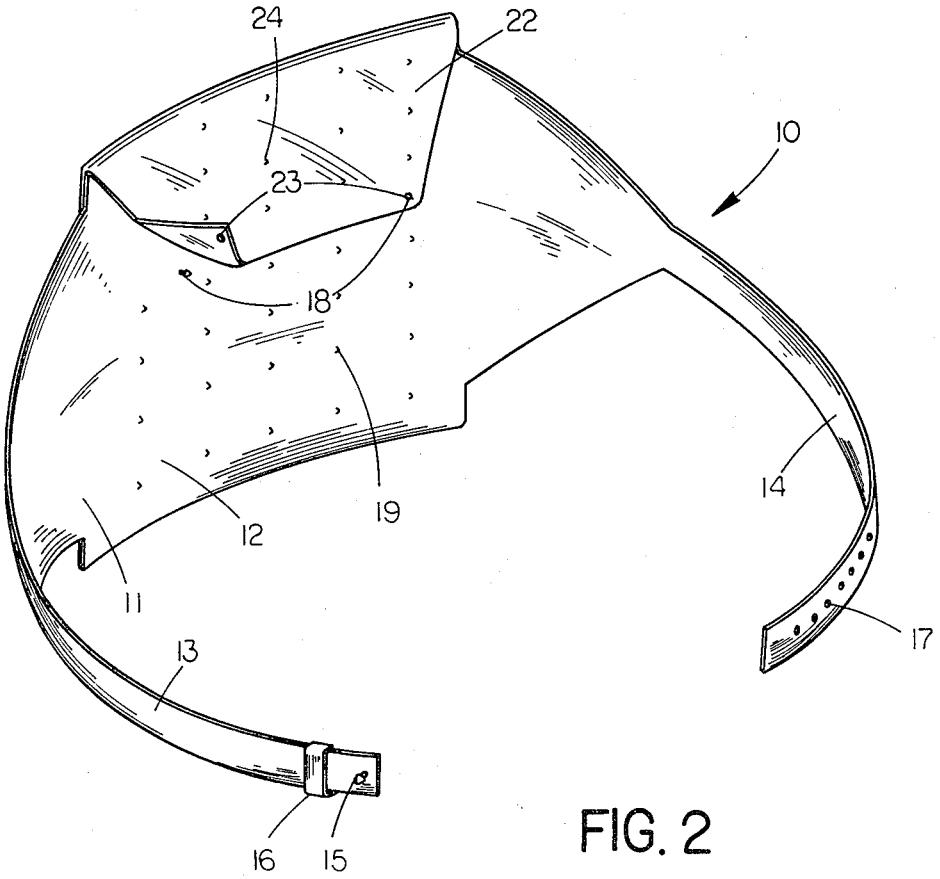
FIG. 2 is a rear perspective view showing a flap provided for interchanging maps in the ski area map holder.
Figure 3:
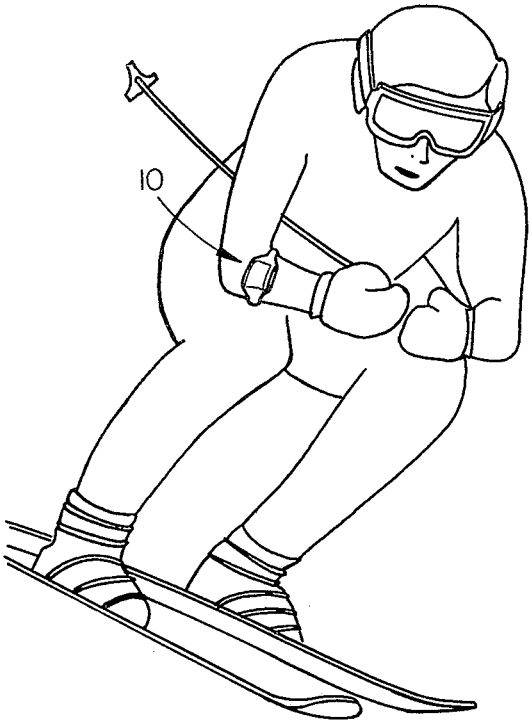
FIGS. 3–5 show the instant invention in use on a skier's forearm.
Figure 4:
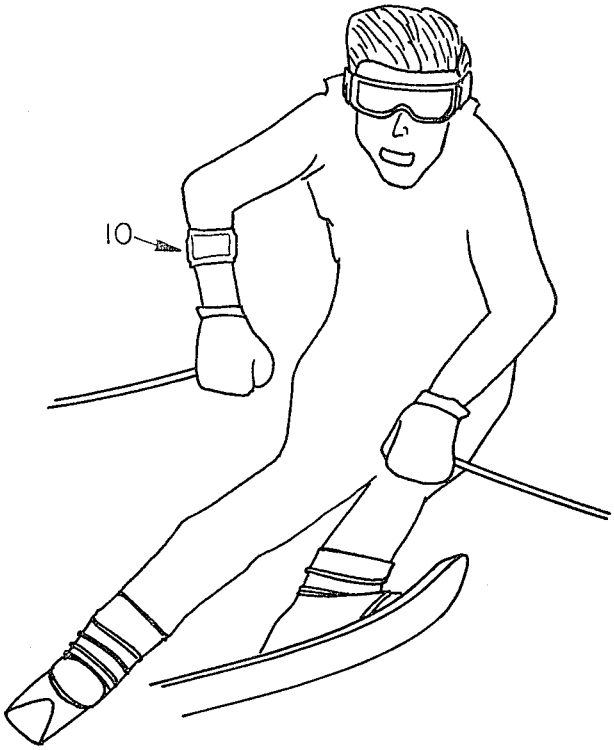
Figure 5:
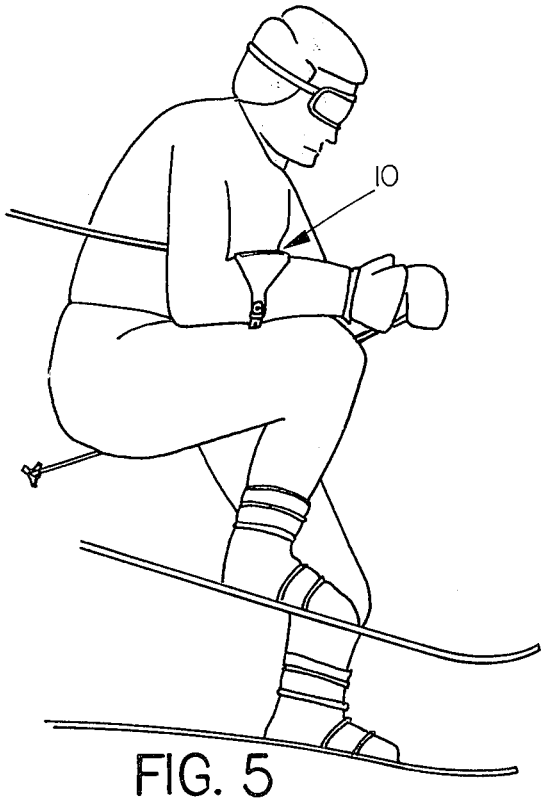
Figure 6:
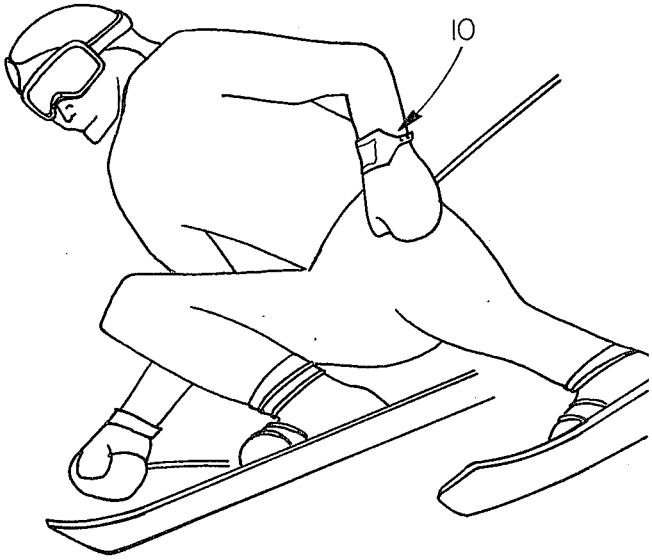
FIG. 6 shows the instant invention in use on a skier's wrist.

FIGS. 1 and 2 illustrate a preferred embodiment of the ski area map holder, shown generally at 10, which is designed to be strapped onto a skier's arm. The position and snugness can be adjusted as desired by the particular skier. The map holder 10 consists of two elements. The primary element is the planar support element 11 which is a pliable structure. The planar support element 11 is shaped to provide a rectangular map supporting section 12 at its approximate center and male and female strap sections 13 and 14, respectively, to either side. For added strength, each strap section is gusseted where it joins the rectangular map supporting section 12.

The male strap 13 has a boss 15 with an enlarged head near its end and an adjacent loop 16 on the side towards the rectangular map supporting section. The female strap 14 has a row of perforations 17 centered along an appropriate section of its length. The support element 11 further has two bosses 18 with enlarged heads located on its back along with a plurality of smaller equally spaced nipples 19. Construction of the planar support element 11 is contemplated to be primarily of an injection molded opaque plastic, but other materials and processes well known in the art could be utilized. The planar support element 11 is sufficiently pliable and thin so that the map holder 10 can be easily wrapped around a skier's limb. The flexibility also makes the map holder 10 safe and unobtrusive for the active sport of skiing.

The second element of the map holder 10 is the translucent map enclosing element 21. The map enclosing element 21 is a planar translucent structure with a rectangular section substantially the same size and shape as the map supporting section 12 of the planar support element 11 and a trapezoidal section which functions as a flap 22, its base being one of the sides not adjacent to a strap side of the rectangular section. The other three sides of the rectangle are affixed by heat welding or the like to the map supporting section 12 of the planar support element 11. A crease is formed by heat pressing or the like at the base of the flap 22 in order to minimize the space through which snow can enter. Two perforations 23 in the flap 22 are located to engage the bosses 18 on the back of the planar support element 11. The flap 22 is amply sized to form a water-resistant enclosure for a map. Also, on the back of flap 22 are flap nipples 24 similar to those support element nipples 19 on the back of the planar support element 11. The flap nipples 24 are formed by heat stamping means or the like. The support element nipples 19 and flap nipples 24 help prevent the map holder 10 from slipping away from the position in which a skier might place it on his limb.

The ski area map holder 10 is utilized by first inserting an appropriately sized printed ski area map between the planar support element 11 and the map enclosing element 21. The flap 22 is then folded over and closed by snapping the holes or perforations 23 over the bosses 18 on the back of the planar support element 11. With the map in place and visible through the map enclosing element 21, the map holder can be placed on the skier's arm by wrapping the holder around the arm until the ends of the straps 13 and 14 meet. The female strap 14 is inserted into the loop 16 and pulled through until the holder 10 is as snug as desired. The straps are then secured by snapping one of the perforations 17 in the female strap 14 onto the boss 15 on the male strap 13.

The map holder 10 is preferably made of water-resistant plastic that is relatively thin and light compared to a ski boot, mitten or glove. Since the holder is thin, pliable, and conforms to the roundness of the skier's arm or wrist as well as folds in his jacket as he opens and closes his arm, it is safe and unencumbering in active skiing (FIGS. 3–6). The translucent plastic cover 21 and flap 22 would satisfactorily prevent moisture from reaching a paper map under normal skiing conditions. The materials and construction techniques chosen for the map holder 10 allow it to be manufactured inexpensively and to be stored flat and compactly in large quantities. The holder is less likely to be lost and is capable of enduring more use than a conventional map. It may thus be no more costly to provide free to lift ticket purchasers than current unprotected paper maps.

The ski area map holder 10 can be altered in many ways within the basic concept of this invention. For instance, the planar support element 11 itself could be translucent and the map held in place behind it by an opaque element. The strap could utilize other connecting means such as a hook and loop fabric fastener, velcro fasteners, double "D" rings, or a conventional buckle. Also, an elastic band could be utilized in place of straps. A tracky rubber lining could replace the nipples in stopping slippage. Additionally, the map holder 10 could be manufactured in a curved rather than flat shape, so that it would conform more readily to the shape of a skier's limb. The map holder could also be manufactured so that it would retain whatever curved shape a particular skier may desire to bend it into.

The single most significant variation in the design is the alternative of permanently attaching the map to the planar support element 11. Some of the ways of accomplishing this are for the map to be printed directly or adhesively secured onto the exposed surface of the support element, or, on the back of a translucent portion of the support element. Also, a map could be permanently incorporated into a plastic lamination similar to the preferred embodiment, without any flap for exchanging maps. Any of these alternative embodiments would provide a water-resistant holder and map enclosure.

Obvious numerous modifications and variations of the present invention are possible in light of the above teachings. It is therefore to be understood that within the scope of the appended Claims, the invention may be practiced otherwise than as specifically described therein.

We claim:

1. A map holder which is adaptable for use by a skier while skiing, comprising:

a pliable planar support element including a rectangular map supporting section, a male strap section, and a female strap section, said strap sections being attached to and extending outwardly from opposite sides of said map supporting section;

said map supporting section including an interior side having a plurality of spaced apart friction nipples formed thereon and a pair of bosses attached thereto and extending outwardly therefrom;

said male strap including an outwardly extending boss attached near its free end and a retaining loop attached intermediate said boss and said map supporting section;

said female strap including a plurality of perforations formed therein and spaced along a section of its length, said perforations adapted to matingly engage said boss on said male strap to secure said map holder on a limb of the skier;

a pliable planar translucent rectangular map enclosing element sealed along three of its outer edges to three outer edges of said map supporting section thereby forming a map pocket therebetween;

a flap attached to and extending from a fourth edge of said map enclosing element, said flap being disposed to fold over the interior side of said map supporting section, said flap including a plurality of spaced apart friction nipples formed thereon and a pair of perforations formed therein and adapted to matingly engage said pair of bosses on the interior side of said map supporting section to secure said flap in a closed position, thereby providing a water-resistant map pocket.

2. The map holder of claim 1 wherein a map is printed on the exposed surface of the support element.

3. The map holder of claim 1 wherein a portion of the support element is translucent and a map is printed on the exposed surface of the support element to be read through the translucent portion.

* * * * *